US008721004B2

(12) United States Patent
Wuang

(10) Patent No.: US 8,721,004 B2
(45) Date of Patent: May 13, 2014

(54) CHAIR STRUCTURE

(75) Inventor: James Wuang, Elk Grove Village, IL (US)

(73) Assignee: Technatel Corp., Elk Grove Village, IL (US)

( * ) Notice: Subject to any disclaimer, the term of this patent is extended or adjusted under 35 U.S.C. 154(b) by 10 days.

(21) Appl. No.: 13/549,382

(22) Filed: Jul. 13, 2012

(65) Prior Publication Data

US 2014/0015299 A1 Jan. 16, 2014

(51) Int. Cl.

| | |
|---|---|
| ***A47C 7/02*** | (2006.01) |
| ***A47C 1/12*** | (2006.01) |
| ***A47C 7/00*** | (2006.01) |

(52) U.S. Cl.

USPC ..... 297/452.21; 297/446.2; 297/440.22

(58) Field of Classification Search

USPC ..... 297/446.2, 446.1, 445.1, 440.22, 297/452.21, DIG. 10

See application file for complete search history.

(56) References Cited

U.S. PATENT DOCUMENTS

| | | | | |
|---|---|---|---|---|
| 3,086,225 | A * | 4/1963 | Fillingim | 5/651 |
| 3,632,150 | A * | 1/1972 | Milakovich | 297/440.22 |
| 5,382,082 | A * | 1/1995 | Fatchett | 297/440.22 |
| 5,439,270 | A * | 8/1995 | Owen | 297/452.27 |
| 6,017,092 | A * | 1/2000 | Lee | 297/440.15 |
| 6,457,773 | B1 * | 10/2002 | Gates | 297/228.12 |
| 6,997,513 | B2 * | 2/2006 | Ige et al. | 297/445.1 |

FOREIGN PATENT DOCUMENTS

| | | | |
|---|---|---|---|
| DE | 3223197 | A1 * | 12/1983 |
| DE | 3810980 | A1 * | 10/1989 |
| EP | 637423 | A1 * | 2/1995 |

* cited by examiner

*Primary Examiner* — Milton Nelson, Jr.
(74) *Attorney, Agent, or Firm* — Che-Yang Chen; Law Office of Michael Chen

(57) ABSTRACT

A chair structure includes a main body and a cushion. When the cushion is disposed on the cushion frame of the main body, the cushion is forwardly inclined to naturally enable the pelvis of the user to incline in the same manner and enable the lumbar vertebra to naturally curve, so that the ischium of the user's hips would sustain most upper body weight of the user instead of the pelvis. Also, it reduces the pressure between the thigh of the user and the front edge of the chair, so the user can sit on the chair for a longer period of time while the spine can naturally maintain an S shape to reduce physical/physiological uncomfortableness caused by improper sitting manner.

5 Claims, 4 Drawing Sheets

CHAIR STRUCTURE

FIELD OF THE INVENTION

The present invention relates to a chair structure, and more particularly to a chair cushion that is forwardly inclined to effectively reduce physical/physiological uncomfortableness caused by improper sitting manner.

BACKGROUND OF THE INVENTION

In conventional chair structure, the chair cushion is usually parallel with the floor, and the angle between the cushion and a backrest is usually less than 90 degrees, so the user may easily feel physically/physiologically uncomfortable, and the user may not sit on the chair for a long period of time. Furthermore, the user may suffer from pain or sickness if sitting on the chair on a regular basis. Therefore, there remains a need for a new and improved chair structure to overcome the problems stated above.

SUMMARY OF THE INVENTION

The present invention provides a chair structure to solve the problems stated above. The main purpose of the present invention is to provide a chair structure having cushion disposed on a cushion frame of a main body, the cushion forwardly inclined to naturally enable the pelvis of the user to incline in the same manner and enable the lumbar vertebra to naturally curve, so that the ischium of the user's hips would sustain most upper body weight of the user instead of the pelvis. Also, it reduces the pressure between the thigh of the user and the front edge of the chair, so the user can sit on the chair for a longer period of time while the spine can naturally maintain an S shape to reduce physical/physiological uncomfortableness caused by improper sitting manner.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
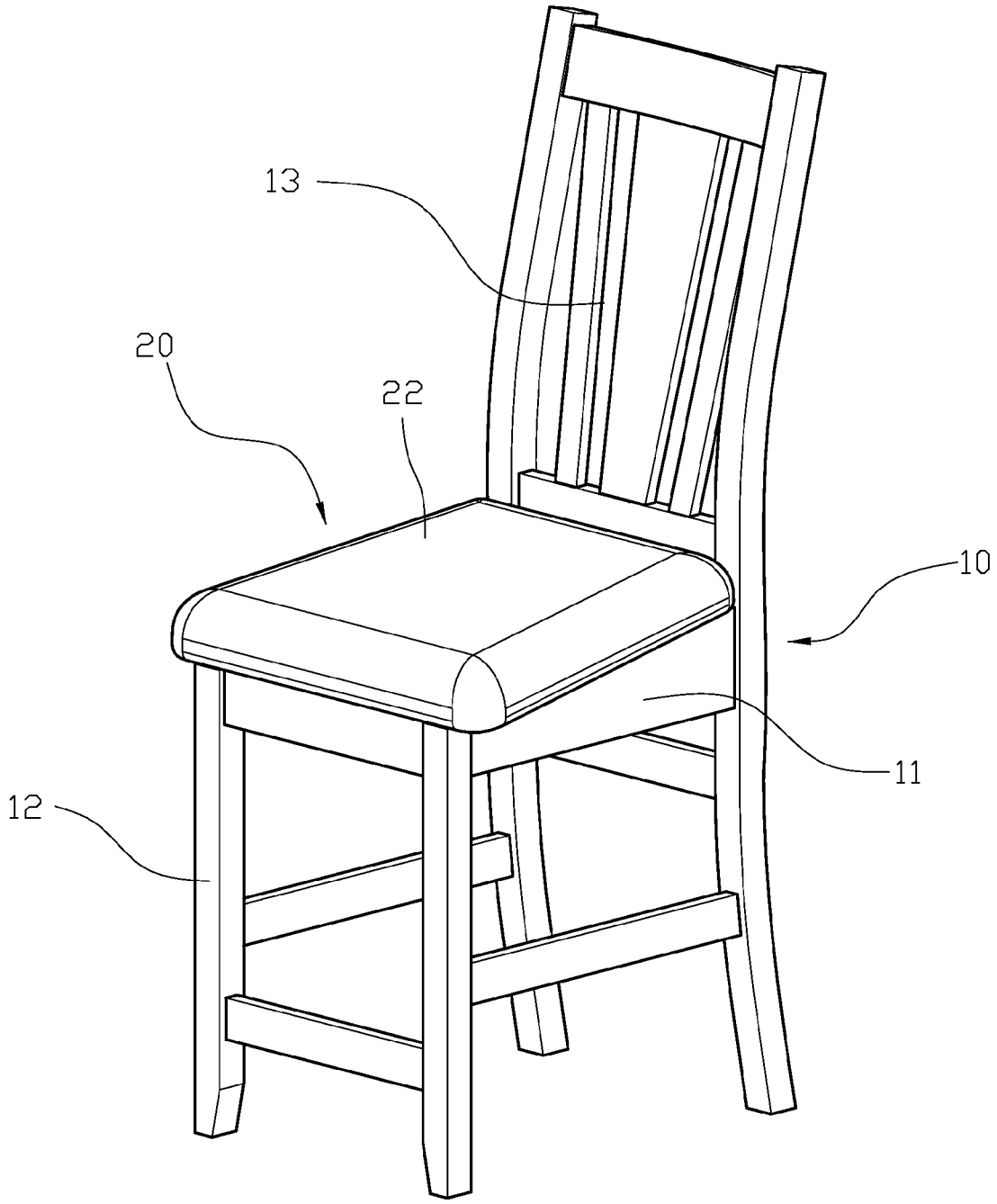
FIG. 1 illustrates a three-dimensional view in the present invention.
Figure 2:
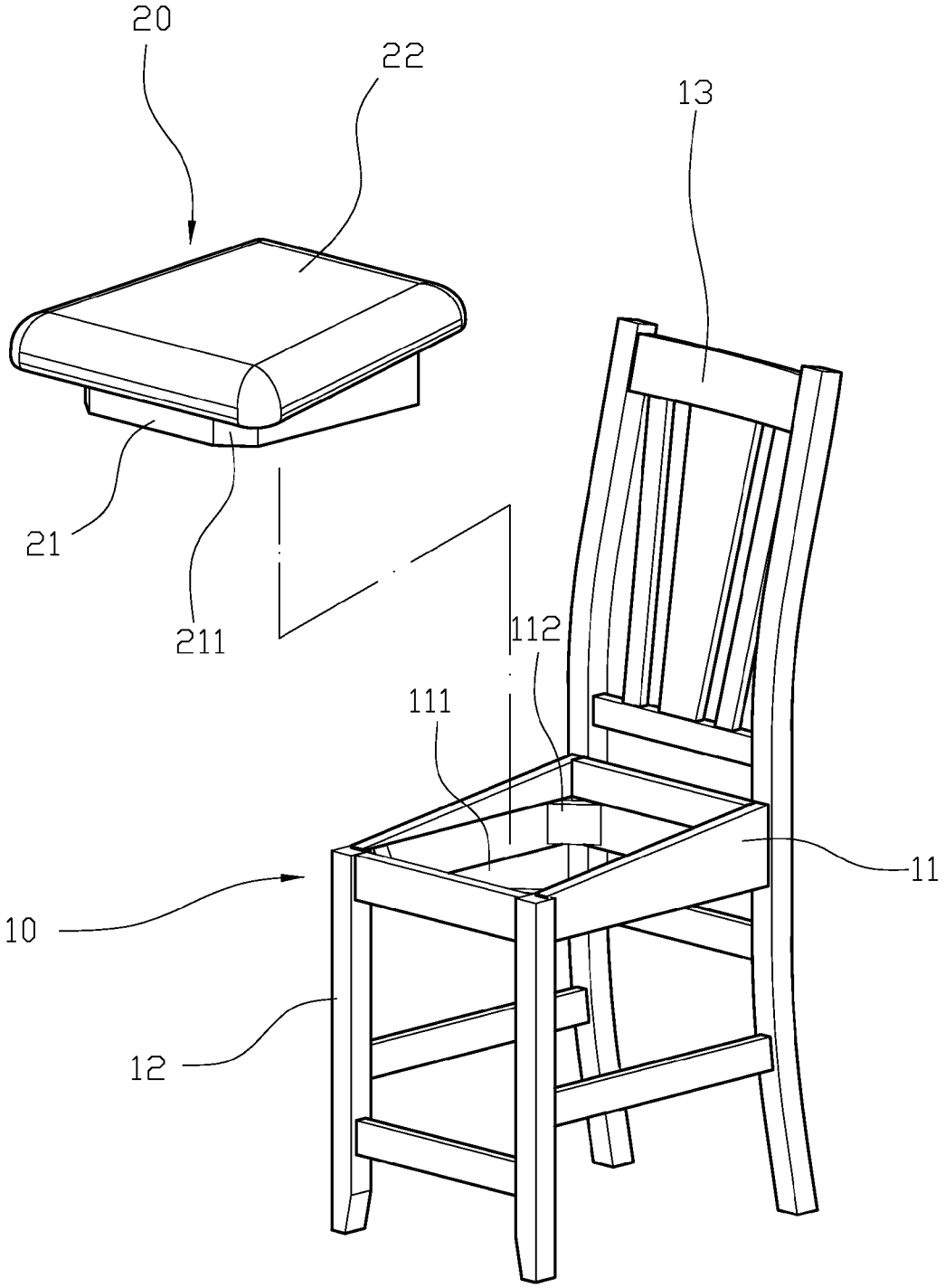
FIG. 2 illustrates an exploded view in the present invention.

In order to further understand the goal, characteristics and effect of the present invention, a number of embodiments along with the drawings are illustrated as following:

Referring to FIGS. 1 to 2, the present invention provides a chair structure including a main body (10) and a cushion (20). The main body (10) has a rectangular cushion frame (11) that has at least four feet (12) downwardly formed from four corners, and a backrest portion (13) is formed from two feet extended on one side. The cushion frame (11) defines a rectangular space (111), and an opening of the upper portion of the cushion frame (11) inclines towards the backrest portion (13) from front feet with an angle, forming a front portion lower than a rear portion. The inclined angle is between 5 to 45 degrees, preferably 15 degrees. The cushion (20) is disposed on the cushion frame (11) of the main body (10), and has a rectangular connecting block (21) that has an inclined upper surface, front portion of which is lower than rear portion. Also, a cushion body (22) expands to cover the periphery of the connecting block (21) and inclines along with the upper surface of the connecting block (21). A wedge block (112) is connected to each of the four corners of the rectangular space (111) of the cushion frame (11), and four corners of the connecting block (21) of the cushion (20) are arranged to form wedging surfaces (211).

Figure 3:
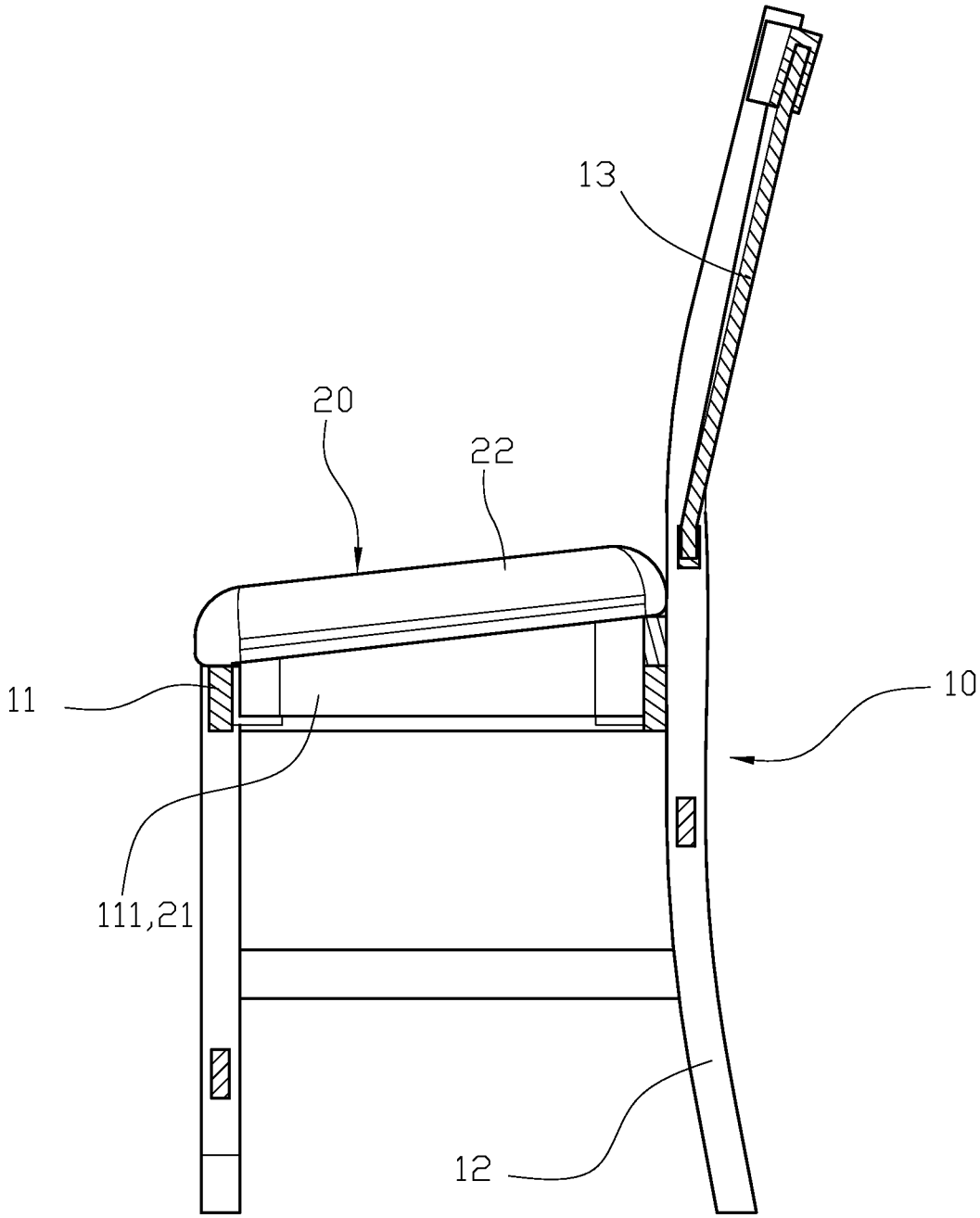
FIG. 3 illustrates a sectional view of the assembled faucet in the present invention.
Figure 4:
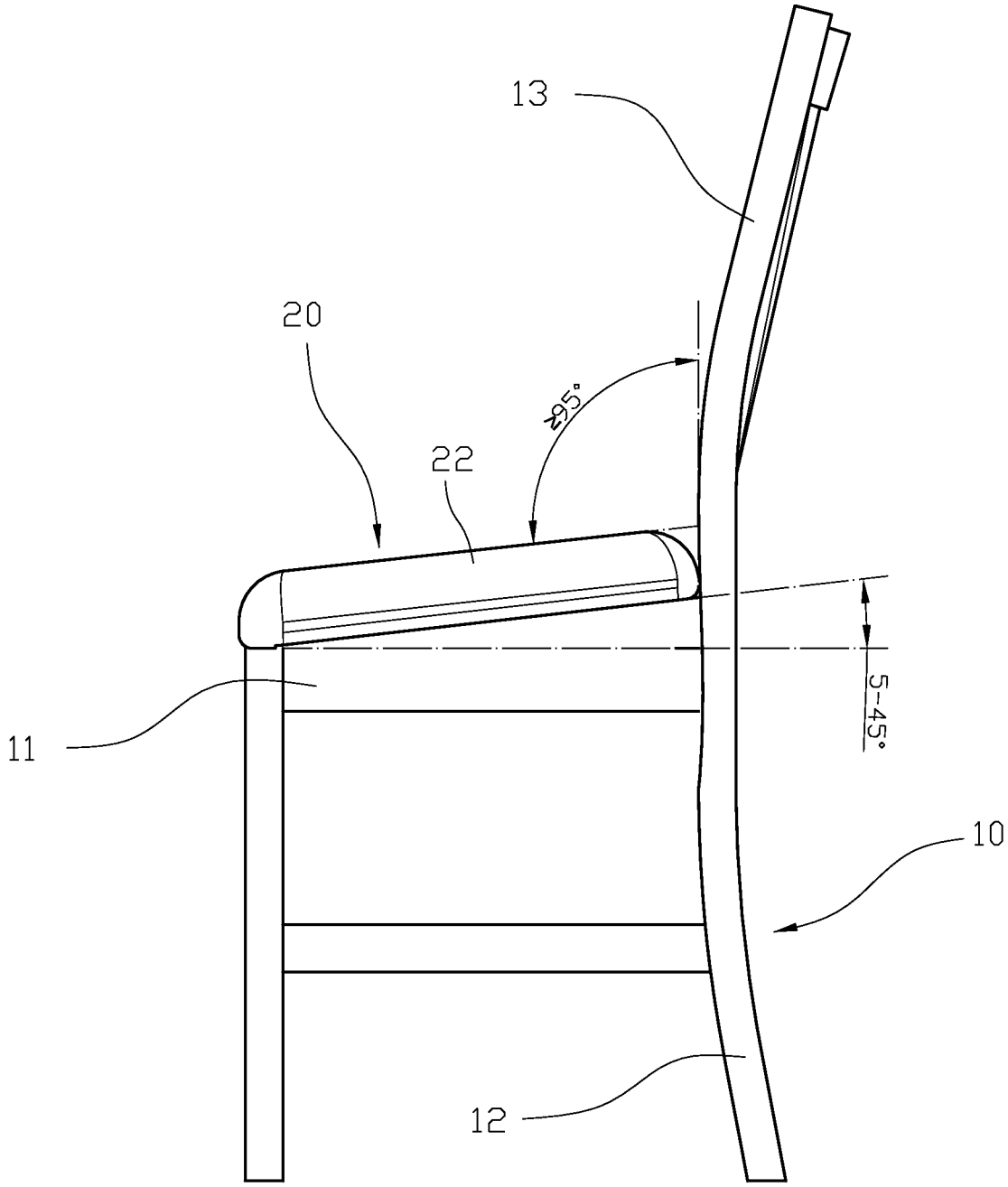
FIG. 4 illustrates a lateral view of the chair structure in the present invention.

Referring to FIGS. 2 to 4 for the structure of the present invention, the cushion (20) is disposed in the cushion frame (11) of the main body (10), and the cushion (20) is fixed into the rectangular space (111) of the cushion frame (11) through the connecting block (21), so that a bottom portion of the cushion body (22) of the cushion (20) can be against an upper edge of the cushion frame (11), and when the cushion (20) is disposed on the cushion frame (11) of the main body (10), the front surface of the cushion (20) is lower than the rear surface thereof. Furthermore, the cushion (20) and the backrest portion (13) forms an angle from 95 to 135 degrees, and a chair structure is accordingly obtained.

Comparing with the conventional arts, the present invention is advantageous because when the cushion (20) is disposed on the cushion frame (11) of the main body (10), the cushion (20) is forwardly inclined to naturally enable the pelvis of the user to incline in the same manner and enable the lumbar vertebra to naturally curve, so that the ischium of the user's hips would sustain most upper body weight of the user instead of the pelvis. Also, it reduces the pressure between the thigh of the user and the front edge of the chair, so the user can sit on the chair for a longer period of time while the spine can naturally maintain an S shape to reduce physical/physiological uncomfortableness caused by improper sitting manner.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A chair structure comprising:

a main body, having a rectangular cushion frame that has at least four feet downwardly formed from four corners, and a backrest portion formed from two feet extended on one side, wherein the cushion frame defines a rectangular space, and an opening of an upper portion of the cushion frame inclines towards the backrest portion from front feet with an angle, forming a front portion lower than a rear portion; and a cushion disposed on the cushion frame of the main body, having a rectangular connecting block that has an inclined upper surface, a front portion of which is lower than a rear portion; and a cushion body expanding to cover a periphery of the connecting block and inclines along with the upper surface of the connecting block.

2. The chair structure of claim 1, wherein a wedge block is connected to each of the four corners of the rectangular space of the cushion frame, and four corners of the connecting block of the cushion are arranged to form wedging surfaces.

3. The chair structure of claim 1, wherein the upper portion of the cushion frame inclines towards the backrest portion from the front feet with an angle, which is between 5 to 45 degrees.

4. The chair structure of claim 3, wherein the angle is 15 degrees.

5. The chair structure of claim 1, wherein when the cushion is disposed on the cushion frame of the main body, the front surface of the cushion is lower than the rear surface thereof, and the cushion and the backrest portion forms an angle from 95 to 135 degrees.

* * * * *